US012207772B2

(12) United States Patent
Lu

(10) Patent No.: US 12,207,772 B2
(45) Date of Patent: Jan. 28, 2025

(54) WIPER BLADE ASSEMBLY AND WINDOW WIPER

(71) Applicant: Yan Lu, Jiaxing (CN)

(72) Inventor: Yan Lu, Jiaxing (CN)

( * ) Notice: Subject to any disclaimer, the term of this patent is extended or adjusted under 35 U.S.C. 154(b) by 316 days.

(21) Appl. No.: 17/837,069

(22) Filed: Jun. 10, 2022

(65) Prior Publication Data

US 2022/0296054 A1 Sep. 22, 2022

Related U.S. Application Data

(63) Continuation of application No. PCT/CN2020/139169, filed on Dec. 24, 2020.

(30) Foreign Application Priority Data

Jan. 3, 2020 (CN) ..... 202020010257.6
Feb. 25, 2020 (CN) ..... 202020208045.9
Dec. 3, 2020 (CN) ..... 202022896854.6

(51) Int. Cl.
*A47L 1/08* (2006.01)
*A47L 1/06* (2006.01)

(52) U.S. Cl.
CPC .. *A47L 1/08* (2013.01); *A47L 1/06* (2013.01)

(58) Field of Classification Search
CPC ..... A47L 1/00; A47L 1/05; A47L 1/06; A47L 1/08; A47L 1/09; A47L 1/095; A47L 13/11; B60S 3/045
USPC ..... 15/248.1, 232, 236.02
See application file for complete search history.

(56) References Cited

U.S. PATENT DOCUMENTS 1,376,195 A * 4/1921 Fernandez ..... A47L 1/08 15/118
5,184,372 A * 2/1993 Mache ..... A47L 13/11 15/245
5,970,560 A * 10/1999 Leroux ..... A47L 1/06 15/119.1
6,010,267 A * 1/2000 Vito ..... A47L 1/08 401/138

(Continued)

FOREIGN PATENT DOCUMENTS

CN 203263278 U 11/2013
CN 204618089 U 9/2015

(Continued)

*Primary Examiner* — Eric J Rosen
*Assistant Examiner* — Aaron R McConnell
(74) *Attorney, Agent, or Firm* — Bayramoglu Law Offices LLC

(57) ABSTRACT

A window wiper is provided. A wiper blade assembly includes a wiper blade and a mounting part. The wiper blade includes a first layer and a second layer which are arranged in a layered manner. The first layer is a scrubbing layer made of a rubber material, silica gel material, soft PVC material or EVA material, and the second layer is a guide layer made of a water-absorbing material. A rear end of the wiper blade is connected with the mounting part, and its front end is a free end. The window wiper includes the wiper blade assembly, a wiper blade mounting frame and a handle, wherein the wiper blade mounting frame is provided with a water receiving port. When the wiper blade assembly is mounted on the handle through the wiper blade mounting frame, the guide layer is located above the water receiving port.

11 Claims, 10 Drawing Sheets

(56) References Cited

U.S. PATENT DOCUMENTS

| | | | | |
|---|---|---|---|---|
| 6,378,159 | B1 * | 4/2002 | Garrison | A47L 13/11 15/118 |
| 6,668,418 | B2 * | 12/2003 | Bastien | A47L 1/06 15/245 |
| 7,470,078 | B2 * | 12/2008 | Banco | A47L 1/08 401/27 |
| 7,594,294 | B2 * | 9/2009 | Billig | A47L 1/08 15/245 |
| 8,926,210 | B2 * | 1/2015 | Orubor | A47L 1/00 16/427 |

FOREIGN PATENT DOCUMENTS

| | | | |
|---|---|---|---|
| CN | 204797739 | U | 11/2015 |
| CN | 206295323 | U | 7/2017 |
| CN | 211633050 | U | 10/2020 |
| JP | H09238870 | A | 9/1997 |

* cited by examiner

WIPER BLADE ASSEMBLY AND WINDOW WIPER

CROSS REFERENCE TO THE RELATED APPLICATIONS

This application is the continuation application of International Application No. PCT/CN2020/139169, filed on Dec. 24, 2020, which is based upon and claims priority to Chinese Patent Applications No. 202020010257.6, filed on Jan. 3, 2020; No. 202020208045.9, filed on Feb. 25, 2020; No. 202022896854.6, filed on Dec. 3, 2020; the entire contents of which are incorporated herein by reference.

TECHNICAL FIELD

The invention belongs to the field of daily cleaning products, and particularly relates to a wiper blade assembly and a window wiper.

BACKGROUND

Window wipers are often used to clean glass in daily life. An existing window wiper is usually provided with a wiper blade. When in use, users spray water or cleaning spray onto glass, and then use the window wiper to wipe the glass with the wiper blade on the window wiper to achieve the purpose of cleaning. However, in the process of cleaning, after the glass is wiped with the wiper blade, dirty water will flow down the glass to contaminate the lower part of the glass and wet the ground, which is very inconvenient and needs to be improved.

In addition, window wipers currently sold in the market only have a single function. A spraying device is needed specifically for a contaminant hard to remove from the window, and clear water or cleaning spray needs to be sprayed onto it many times before it is removed, which is cumbersome and extremely inconvenient. In addition, in the cleaning process, after the glass is wiped with the wiper blade, dirty water will flow down to contaminate clothes, floors and the like, causing secondary pollution and increasing the cleaning workload.

SUMMARY

According to one aspect, the invention provides a wiper blade assembly, and the wiper blade assembly includes a wiper blade and a mounting part; and the wiper blade includes a first layer and a second layer which are arranged in a layered manner, the first layer is a scrubbing layer made of a rubber material, silica gel material, soft polyvinyl chloride (PVC) material or ethylene-vinyl acetate (EVA) material, and the second layer is a guide layer made of a water-absorbing material; and a rear end of the wiper blade is connected with the mounting part, and its front end is a free end.

Alternatively, the water-absorbing material is cloth, paper, polyvinyl acetate (PVA) material, sponge, cellulose sponge, superfine fiber cloth, bamboo fiber or water-absorbing resin.

Alternatively, the first layer and the second layer are connected together by sewing, laminating, bonding or tearable bonding.

Alternatively, at a front end of the wiper blade, the first layer outreaches the second layer or is flush with the second layer.

According to the above wiper blade assembly, the wiper blade is formed by superposing the scrubbing layer made of a hydrophobic material and the guide layer made of a water-absorbing material, dirty water coming down with the scrubbing layer forms large water droplets, the water-absorbing material destroys the tension of the large water droplets and quickly absorbs the water, and the water flows down along the guide layer under the action of gravity. In this way, dirty water will not flow down the glass, so as to prevent the lower part of the glass from being contaminated and the ground from being wetted.

According to another aspect, the invention provides a window wiper, including the above wiper blade assembly, a wiper blade mounting frame and a handle, the wiper blade mounting frame is provided with a water receiving port, and when the wiper blade assembly is mounted on the handle through the wiper blade mounting frame, the guide layer is located above the water receiving port.

Alternatively, the handle is provided with a hollow water storage chamber, and the water receiving port communicates with the water storage chamber.

Alternatively, a front end of the wiper blade mounting frame is provided with protrusions.

Alternatively, the wiper blade mounting frame includes a left side face, a rear side face, a right side face, a front side face, and a bottom face, the left side face, the rear side face, the right side face, the front side face, and the bottom face define the water receiving port at the front end in an enclosing manner, and a front end of the left side face, a front end of the right side face, and/or the front side face is provided with the protrusions.

Alternatively, the window wiper further includes a wiper blade mounting base, wherein a mounting part of the wiper blade assembly is a mounting bar, the wiper blade mounting base is provided with a mounting slot matched with the mounting bar, two sides of the wiper blade mounting base are respectively provided with protruding clamping pieces, and two sides of the wiper blade mounting frame are provided with clamping slots matched with the clamping pieces; and the wiper blade assembly is fixed to the wiper blade mounting base by enabling the mounting bar to be clamped into the mounting slot, and the wiper blade mounting base is mounted on the wiper blade mounting frame by enabling the clamping pieces to be clamped into the clamping slots.

Alternatively, the bottom face of the wiper blade mounting frame is also provided with a wiper blade mounting base support for supporting the wiper blade mounting base when the wiper blade mounting base is mounted on the wiper blade mounting frame.

According to the window wiper, by arranging the water receiving port on the wiper blade mounting frame, in use, dirty water coming down with the scrubbing layer flows down into the water receiving port along the guide layer, and then into the water storage chamber, thus further ensuring that the dirty water will not flow down along the glass, so as to prevent the lower part of the glass from being contaminated and the ground from being wetted.

According to yet another aspect, the invention provides a window wiper, including the above wiper blade assembly; a dirty water receiving assembly, the dirty water receiving assembly including a dirty water receiver with a dirty water receiving chamber and a dirty water bottle, wherein when the wiper blade assembly is fixed to the dirty water receiver, the guide layer of the wiper blade assembly is located above the dirty water receiving chamber, and the dirty water receiving chamber is used for receiving dirty water coming down with the wiper blade assembly and communicates with the dirty water bottle; the dirty water bottle has a bottle mouth for communicating with the outside and a bottle cap for sealing or exposing the bottle mouth, and the dirty water can be discharged to the outside through the bottle mouth of the dirty water bottle; and a water spraying assembly detachably connected to the dirty water receiving assembly, the water spraying assembly including a spraying device and a clear water bottle for containing water and/or detergent, and the spraying device communicating with the clear water bottle and being used for spraying water and/or detergent.

Alternatively, two sides of the wiper blade are provided with mounting bars, a mounting part of the wiper blade assembly includes a first fixing piece and a second fixing piece arranged on a front side and a rear side of the wiper blade respectively, and the first fixing piece and the second fixing piece are respectively provided with mounting slots matched with the mounting bars; and the mounting bars can be clamped into the mounting slots, and the wiper blade assembly is mounted in the dirty water receiving chamber or above the dirty water receiving chamber.

Alternatively, the dirty water receiving assembly further includes water pipes, a bottom of the dirty water receiving chamber of the dirty water receiver is provided with dirty water ports, a top of the dirty water bottle is provided with dirty water nozzles, and the dirty water ports communicate with the dirty water nozzles through the water pipes.

Alternatively, the dirty water bottle includes a first dirty water bottle and a second dirty water bottle which communicate laterally, the bottle mouth and the bottle cap are arranged on one or both of the first dirty water bottle and the second dirty water bottle, and a top of the first dirty water bottle and a top of the second dirty water bottle are respectively provided with a first dirty water nozzle and a second dirty water nozzle; and the bottom of the dirty water receiving chamber of the dirty water receiver is provided with a first dirty water port and a second dirty water port corresponding to the first dirty water nozzle and the second dirty water nozzle, the first dirty water port communicates with the first dirty water nozzle through a first water pipe, and the second dirty water port communicates with the second dirty water nozzle through a second water pipe.

Alternatively, the window wiper further includes a fixing assembly for fixing the spraying device to the dirty water receiver, wherein the fixing assembly includes a first fixing cover and a second fixing cover respectively located at a front side and a rear side of the spraying device, the first fixing cover and the second fixing cover are connected after covering the spraying device, top ends of the first fixing cover and the second fixing cover are connected with the dirty water receiver, and bottom ends of the first fixing cover and the second fixing cover are connected with the clear water bottle.

The window wiper integrates the functions of water spraying and dirty water receiving, overcomes the inconvenience and unsafety of the prior art where manual water spraying is needed or a window wiper needs to be repeatedly wetted during glass wiping, and allows water to be sprayed through the water spraying assembly during window wiping and the dirty water generated from window wiping to be received by the dirty water bottle, so as to avoid secondary pollution and make subsequent treatment of the dirty water easy and fast. In addition, the window wiper has a simple structure and multiple functions and is convenient to use.

DESCRIPTION OF REFERENCE NUMERALS

G—glass; 1—window wiper;

10—wiper blade assembly; 11—wiper blade; 11*a*—first layer; 11*b*—second floor; 100—mounting part; 111—mounting bar; 121—first fixing piece; 122—second fixing piece;

12—wiper blade mounting frame; 12*a*—left side face; 12*b*—rear side face; 12*c*—right side face; 12*d*—front side face; 12*e*—bottom face; 30—water receiving port; 13—protrusion; 14—clamping slot; 15—wiper blade mounting base support;

40—wiper blade mounting base; 41—mounting slot; 42—clamping piece;

20—handle; 200—water storage chamber;

21—dirty water receiver; 20—bottle mouth and cap structure; 221—first dirty water bottle; 222—second dirty water bottle; 223—sealing ring; 23—water pipe; 31—spraying device; 32—clear water bottle; 411—first fixing cover; 412—second fixing cover; 413—fixing ring.

DETAILED DESCRIPTION OF THE EMBODIMENTS

The invention will be further described below with reference to the accompanying drawings and embodiments.

Embodiment

Figure 1:
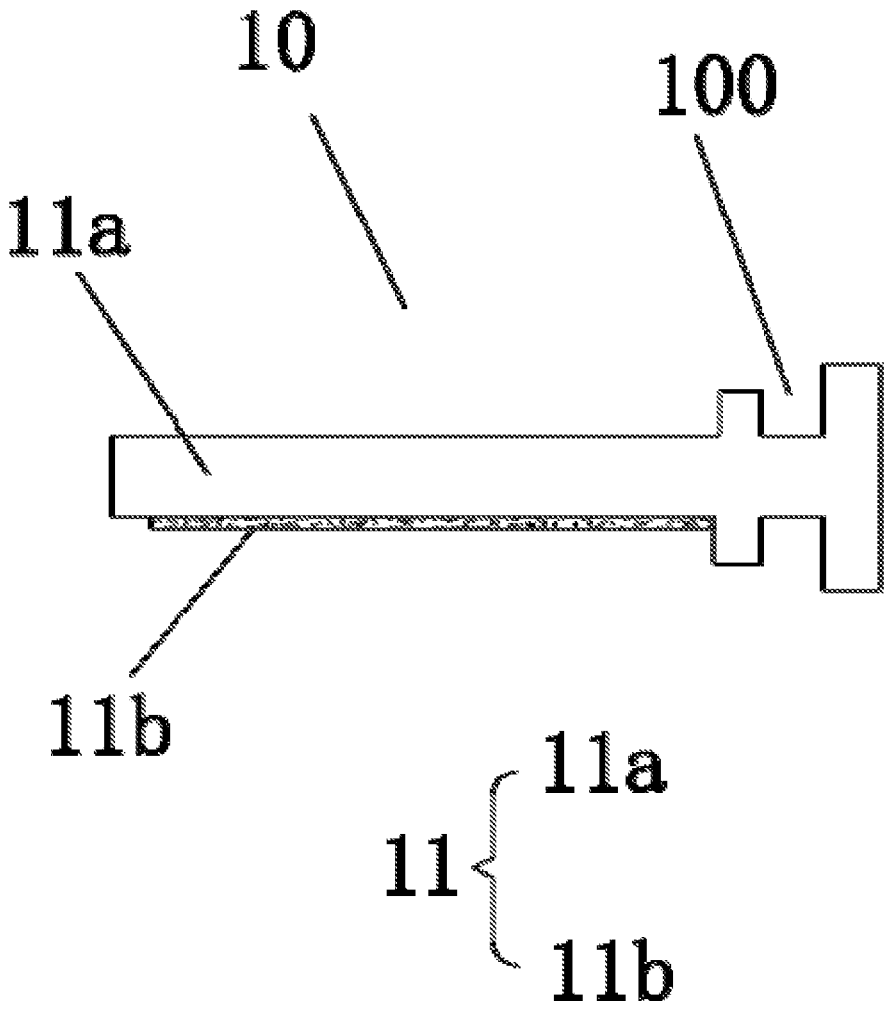
FIG. 1 is a structural diagram of a wiper blade assembly with a guiding function.

As shown in FIG. 1, this embodiment provides a wiper blade assembly with a guiding function. The wiper blade assembly 10 includes a wiper blade 11. The wiper blade 11 is of a layered structure, including a first layer 11*a* and a second layer 11*b* which are connected together. The first layer 11*a* is a scrubbing layer made of a rubber material, silica gel material, soft PVC material or EVA material, and the second layer 11*b* is a guide layer made of a water-absorbing material.

The water-absorbing material is cloth, paper, PVA material, sponge, cellulose sponge, superfine fiber cloth, bamboo fiber or water-absorbing resin.

The first layer 11*a* and the second layer 11*b* are connected together by sewing, laminating, bonding or tearable bonding.

At a front end of the wiper blade 11 (that is, the end on the left side from the view of FIG. 1), the first layer 11*a* outreaches the second layer 11*b*. Alternatively, in other embodiments, they can be flush, that is, the first layer 11*a* does not outreach the second layer 11*b* at the front end.

The wiper blade assembly 10 also includes a mounting part 100 located at a rear end of the wiper blade 11, and the rear end is opposite to the front end.

Figure 2:
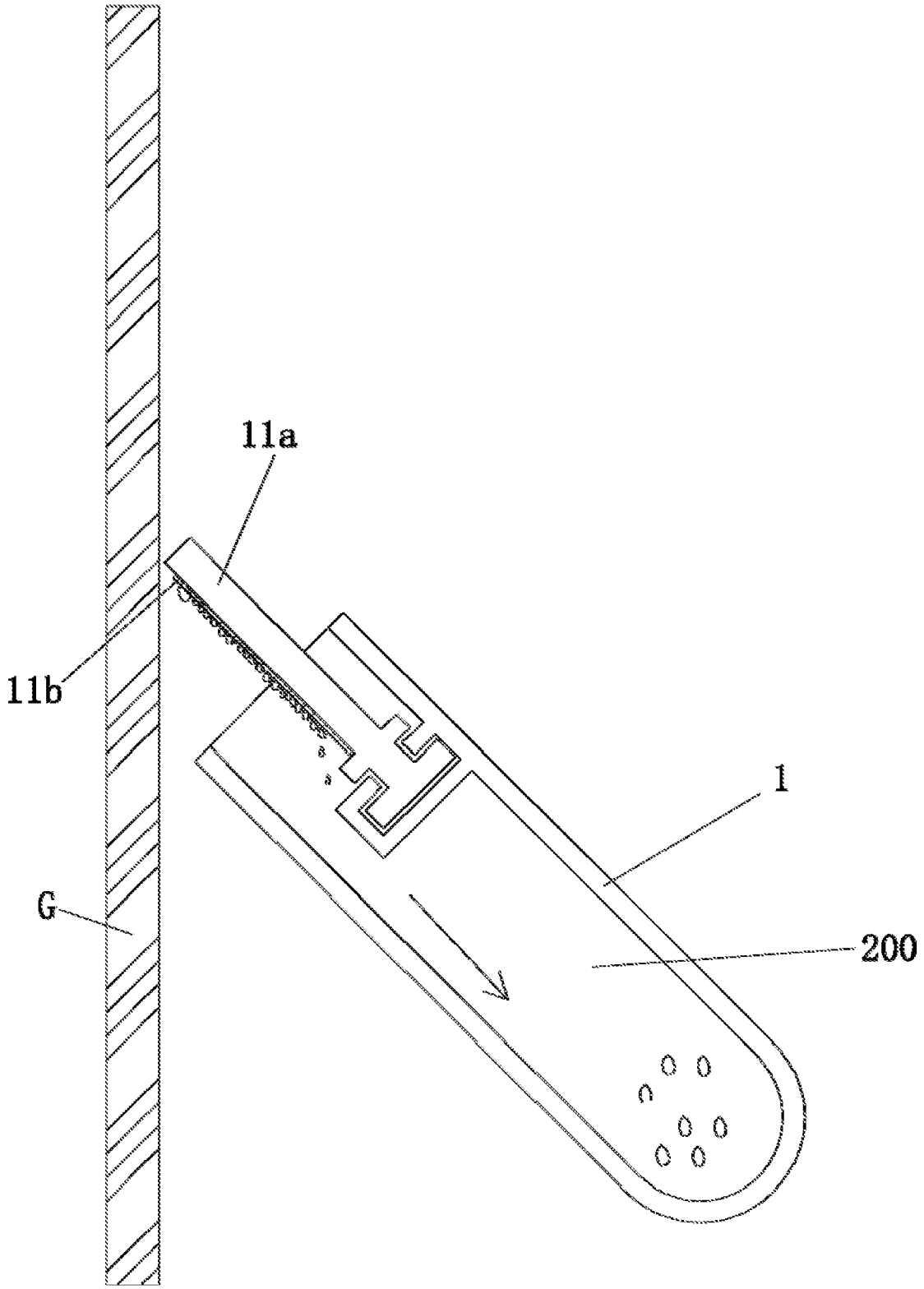
FIG. 2 is a diagram of the use of a wiper blade assembly.

In actual use, as shown in FIG. 2, the wiper blade assembly 10 is mounted on a window wiper 1, a user holds the window wiper 1, a front end of the wiper blade assembly 10 is pressed against glass G, and dirty water coming down with the first layer 11*a* serving as the scrubbing layer flows down the second layer 11*b* serving as the guide layer into a water receiving chamber 21 of the window wiper 1. In this way, dirty water will not flow down the glass, so as to prevent the lower part of the glass from being contaminated and the ground from being wetted.

Figure 3:
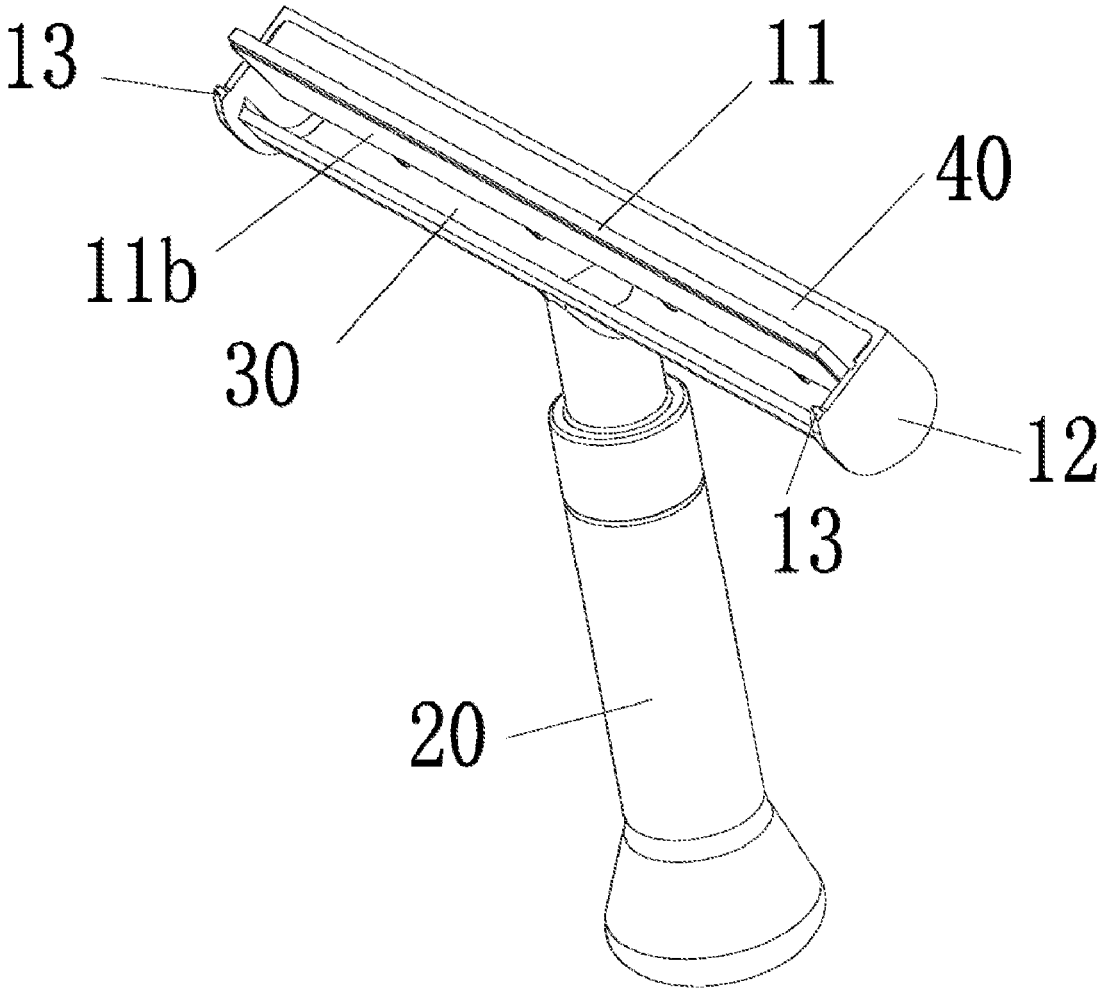
FIG. 3 is a stereogram of a window wiper.
Figure 4:
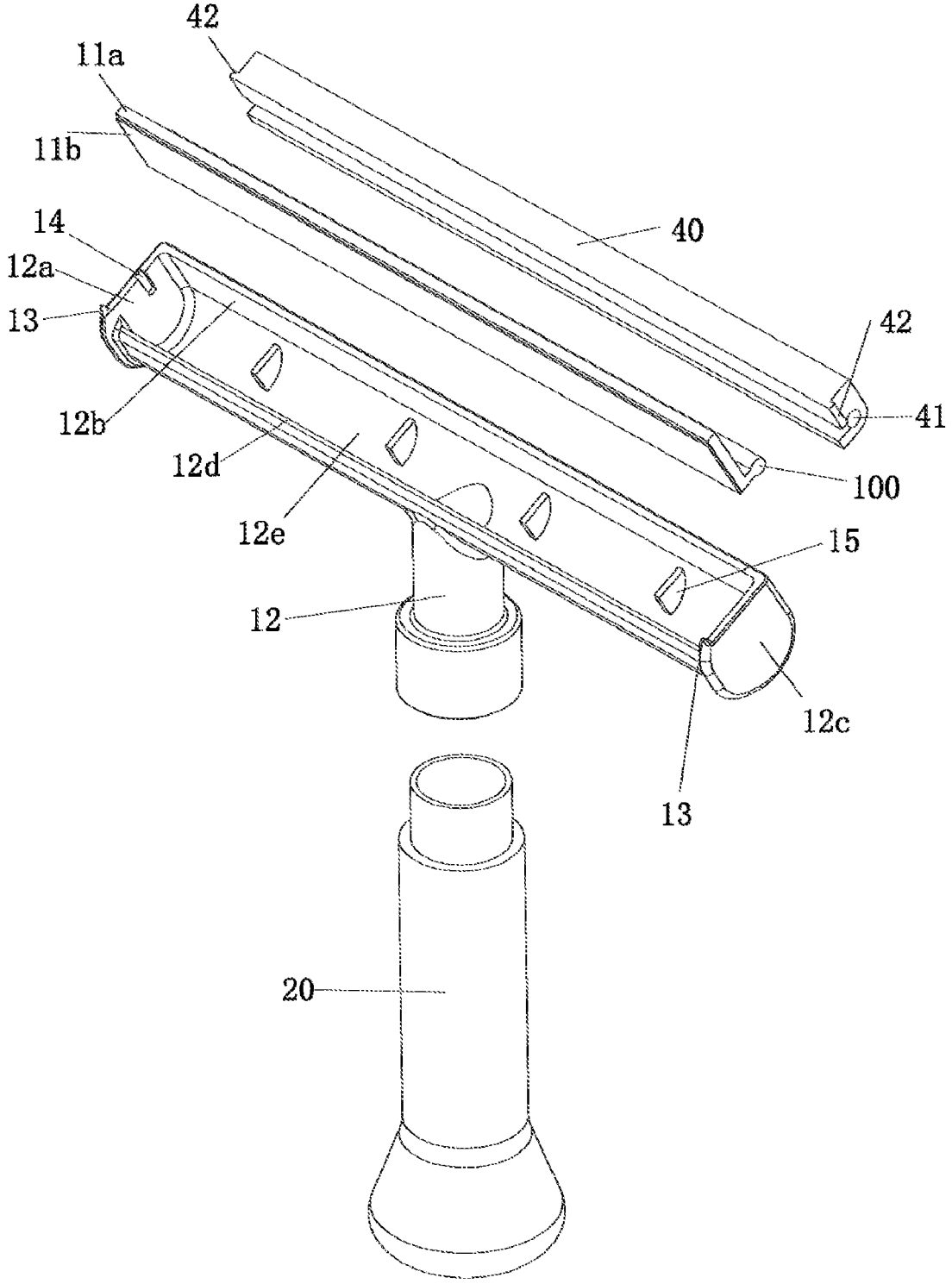
FIG. 4 is an exploded view of the window wiper in FIG. 3.
Figure 5:
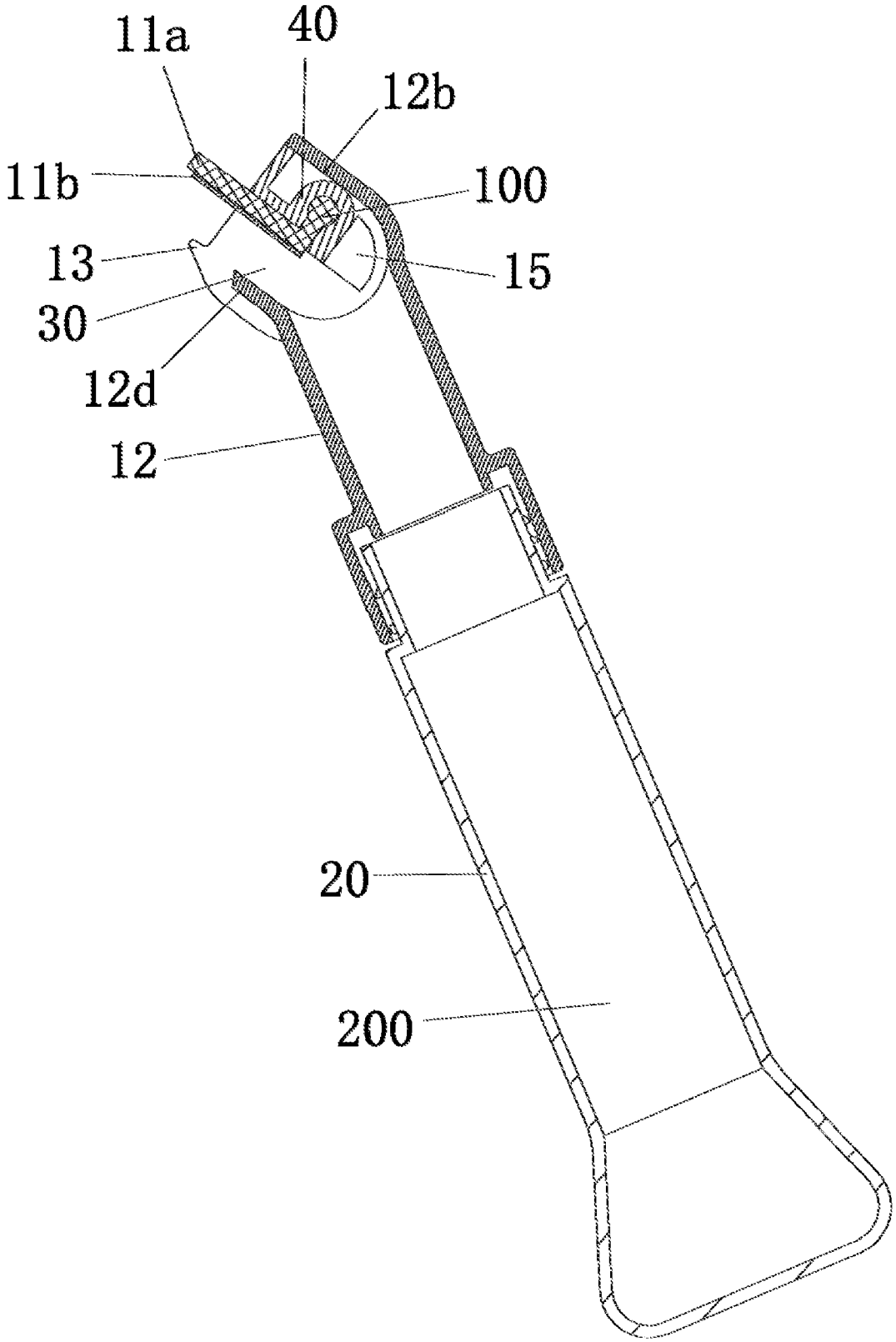
FIG. 5 is a side sectional view of the window wiper in FIG. 3.

As shown in FIGS. 3-5, this embodiment provides a window wiper, which includes a wiper blade assembly 10, a wiper blade mounting frame 12 and a handle 20, wherein the wiper blade assembly 10 is arranged on the wiper blade mounting frame 12, the wiper blade mounting frame 12 is arranged on the handle 20, and connection between the wiper blade assembly 10 and the wiper blade mounting frame 12 and connection between the wiper blade mounting frame 12 and the handle 20 are both detachable connection. The wiper blade assembly 10 includes a wiper blade 11, a second layer 11*b* (lower layer) of the wiper blade 11 is a guide layer, the wiper blade mounting frame 12 is provided with a water receiving port 30, and the guide layer 11*b* is located above the water receiving port 30.

The handle 20 is of a hollow structure, a water storage chamber 200 is formed in the handle 20, and the water receiving port 30 communicates with the water storage chamber 200.

A front side of the wiper blade mounting frame 12 is provided with protrusions 13. Specifically, the wiper blade mounting frame 12 includes a left side face 12*a*, a rear side face 12*b*, a right side face 12*c*, a front side face 12*d*, and a bottom face 12*e* (this is described based on FIG. 4 when viewing from left to right, and when the viewing angle changes, each structural position can be adjusted accordingly), the left side face 12*a*, the rear side face 12*b*, the right side face 12*c*, the front side face 12*d*, and the bottom face 12*e* define the water receiving port 30 in an enclosing manner, and a front end of the left side face 12*a*, a front end of the right side face 12*c*, and/or the front side face 12*d* is provided with protrusions 13. In this embodiment, the protrusions 13 are arranged at the front end of the left side face 12*a* and the front end of the right side face 12*c*.

The window wiper 1 further includes a wiper blade mounting base 40, and the mounting part 100 of the wiper blade assembly 10 may be designed as a mounting bar. The wiper blade mounting base 40 is provided with a mounting slot 41 matched with the mounting bar, and left and right sides of the wiper blade mounting base 40 are provided with protruding clamping pieces 42. The left side face 12*a* and the right side face 12*c* of the wiper blade mounting frame 12 are provided with clamping slots 14 matched with the clamping pieces 42, the wiper blade assembly 10 is fixed to the wiper blade mounting base 40 by enabling the mounting bar to be clamped into the mounting slot 41, and the wiper blade mounting base 40 is mounted on the wiper blade mounting frame 12 by enabling the clamping pieces 42 to be clamped into the clamping slots 14.

The bottom face 12*e* of the wiper blade mounting frame 12 is also provided with a wiper blade mounting base support 15, and the wiper blade mounting base support 15 corresponds to the wiper blade mounting base 40 in position.

Figure 6:
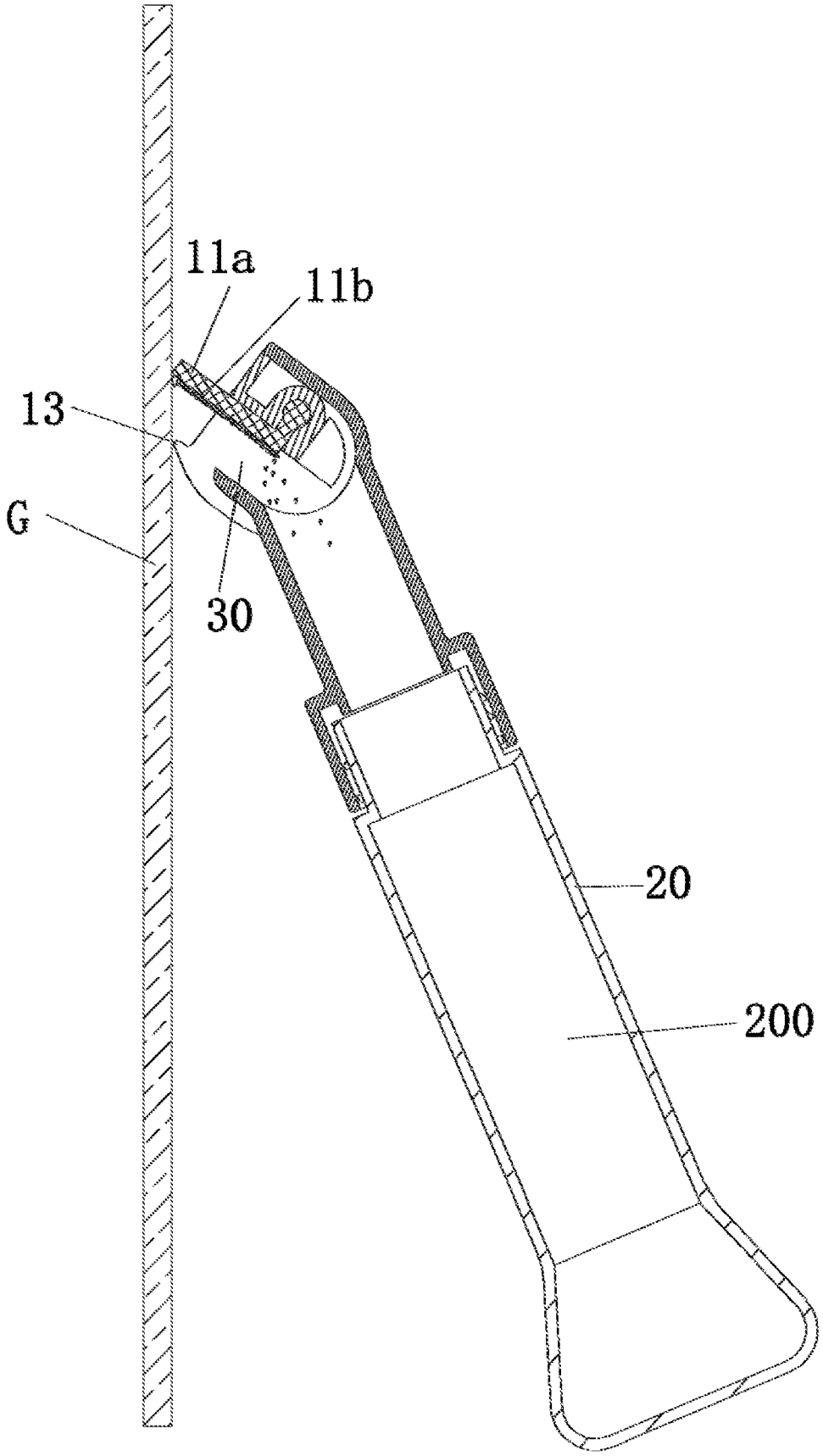
FIG. 6 is a usage state diagram of the window wiper in FIG. 3.

In actual use, as shown in FIG. 6, the user holds the handle 20, the wiper blade 11 is pressed against the glass G, the protrusions 13 are pressed against the glass G, and dirty water coming down with the scrubbing layer 11*a* flows down the guide layer 11*b* into the water receiving port 30 and then into the water storage chamber 200. In this way, dirty water will not flow down the glass, so as to prevent the lower part of the glass from being contaminated and the ground from being wetted. The protrusions 13 are arranged to prevent a front side (i.e. the front side face 12*d*) of the water receiving port 30 from being pressed against the glass to allow the dirty water to flow down.

As shown in FIGS. 7-10, this embodiment provides a window wiper, which includes a wiper blade assembly, a dirty water receiving assembly and a water spraying assembly. The dirty water receiving assembly includes a dirty water receiver 21 and a dirty water bottle. The dirty water receiver 21 is provided with a dirty water receiving chamber. The wiper blade assembly may have the structure of Embodiment 1, which includes a wiper blade 11, the wiper blade 11 includes a first layer 11*a* serving as a scrubbing layer and a second layer 11*b* serving as a guide layer, the wiper blade assembly is detachably connected with the dirty water receiver 21, and water coming down with the wiper blade assembly can flow into the dirty water receiving chamber. Specifically, the wiper blade assembly may be fixed inside or above the dirty water receiving chamber, and the dirty water receiving chamber communicates with the dirty water bottle. The dirty water bottle is provided with a bottle mouth and cap structure 220. The water spraying assembly includes a spraying device 31 and a clear water bottle 32, and the spraying device 31 communicates with the clear water bottle 32.

In this embodiment, the window wiper has three functions, that is, water spraying, scrubbing and dirty water receiving, which overcomes the inconvenience and unsafety of the prior art where manual water spraying is needed or a window wiper needs to be repeatedly wetted during glass wiping, and allows water to be sprayed through the water spraying assembly during window wiping, and the dirty water generated from window wiping to be received by the dirty water bottle so as to avoid secondary pollution and cleaning workload increase. In addition, the bottle mouth and cap structure 220 is arranged on the dirty water bottle to facilitate subsequent treatment of the dirty water. The dirty water in the dirty water bottle can be poured out through a bottle mouth for treatment by unscrewing a bottle cap without disassembling the window wiper.

Further, a front side of the dirty water receiver 21 is provided with a protrusion 13. Preferably, both left and right ends of the front side of the dirty water receiver 21 are provided with protrusions 13. The protrusions 13 are arranged to ensure that a certain distance is maintained between the front side of the dirty water receiver 21 and the glass during glass wiping, so as to prevent the front side of the dirty water receiver 21 from being pressed against the glass to allow the dirty water to flow down to the floor or the lower part of the glass to cause secondary pollution.

Here, the "front side" is a side close to the glass when the window wiper is used.

Figure 10:
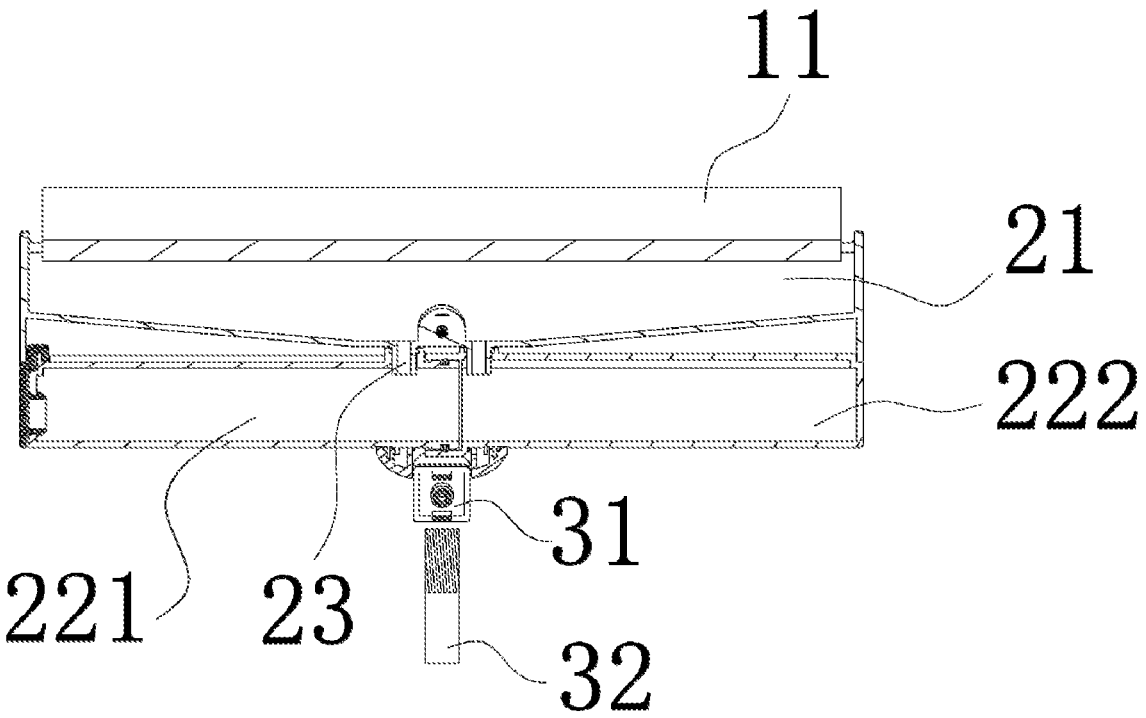
FIG. 10 is a front sectional view of the window wiper in FIG. 7.

Please refer to FIG. 10. As in Embodiment 1, a front end of the first layer 11*a* serving as the scrubbing layer is preferably located outside a front end of the second layer 11*b* serving as the guide layer 112, which can ensure that the dirty water coming down with the scrubbing layer is more thoroughly absorbed by the guide layer, and then flows into the dirty water receiving chamber along the guide layer and finally into the dirty water bottle.

Further, two sides of the wiper blade 11 are provided with mounting bars 111. A mounting part of the wiper blade assembly 10 includes a first fixing piece 121 and a second fixing piece 122. Inner sides of the first fixing piece 121 and the second fixing piece 122 are respectively provided with mounting slots matched with the mounting bars 111. The mounting bars 111 are clamped into the mounting slots, and the first fixing piece 121 and the second fixing piece 122 are fixedly connected to realize fixed connection between the wiper blade 11 and the mounting part. Specifically, the wiper blade is clamped between the first fixing piece 121 and the second fixing piece 122 through the cooperation of the mounting bars 111 and the mounting slots, and the first fixing piece 121 and the second fixing piece 122 are fixedly connected through hook and screw cooperation, thereby forming the wiper blade assembly. The wiper blade assembly is fixed in the dirty water receiving chamber of the dirty water receiver 21; specifically, the mounting part of the wiper blade assembly is fixedly connected with the dirty water receiver in the dirty water receiving chamber, and more specifically, the mounting part and the dirty water receiver 21 are respectively provided with screw holes, and are fixedly connected by screws.

It can be understood that the mounting part is used to fix the wiper blade 11 to prevent the wiper blade 11 from shaking during use. The mounting part includes the first fixing piece 121 and the second fixing piece 122. The wiper blade 11 can be fixed more firmly by the two fixing pieces from both sides.

Further, the dirty water bottle is formed by communication of two small dirty water bottles, which are a first dirty water bottle 221 and a second dirty water bottle 222 respectively. A transverse end of the first dirty water bottle 221 and a transverse end of the second dirty water bottle 222 are connected through a sealing ring 223, so as to ensure connection tightness and prevent dirty water leakage. A top of the first dirty water bottle 221 and a top of the second dirty water bottle 222 are each provided with a dirty water nozzle, a bottom of the dirty water receiver 21 is provided with two corresponding dirty water ports, and the two dirty water ports respectively communicate with the two dirty water nozzles through water pipes 23, so that a drainage function of the water pipes 23 can be improved and the dirty water accumulated in the dirty water receiver can quickly and smoothly flow into the dirty water bottle through the water pipes 23. The other transverse end of the first dirty water bottle 221 and/or the other transverse end of the second dirty water bottle 222 is provided with the bottle mouth and cap structure 220, so that the dirty water can be treated quickly later. Preferably, in this embodiment, only the other transverse end of the first dirty water bottle 221 is provided with the bottle mouth and cap structure 220.

Further, a transverse length of the dirty water bottle is the same as that of the dirty water receiver, and the two are laterally parallel to each other.

Specifically, the spraying device 31 includes a connecting body, a suction pipe, a spray head and a wrench, wherein the spray head is arranged at a front end of the connecting body; preferably, the spray head is a porous atomizing spray head to increase the spray area, one end of the suction pipe is connected with the spray head, and the other end of the suction pipe extends into the clear water bottle to the farthest reaches so that liquid (clear water and/or detergent) can be sucked out of the clear water bottle as much as possible; and the wrench is arranged on the connecting body and used for operating the spray head to spray water.

In the cleaning process, when the water spraying assembly is needed, the wrench is pressed down, the spraying device communicates with the clear water bottle 32, so that the clear water or detergent in the clear water bottle 32 can be sprayed out from the spray head, and when the wrench is released, the spraying device is blocked by the wrench. It can be seen that the water spraying assembly is simple in structure and convenient to install and can save time and labor in use.

Figure 7:
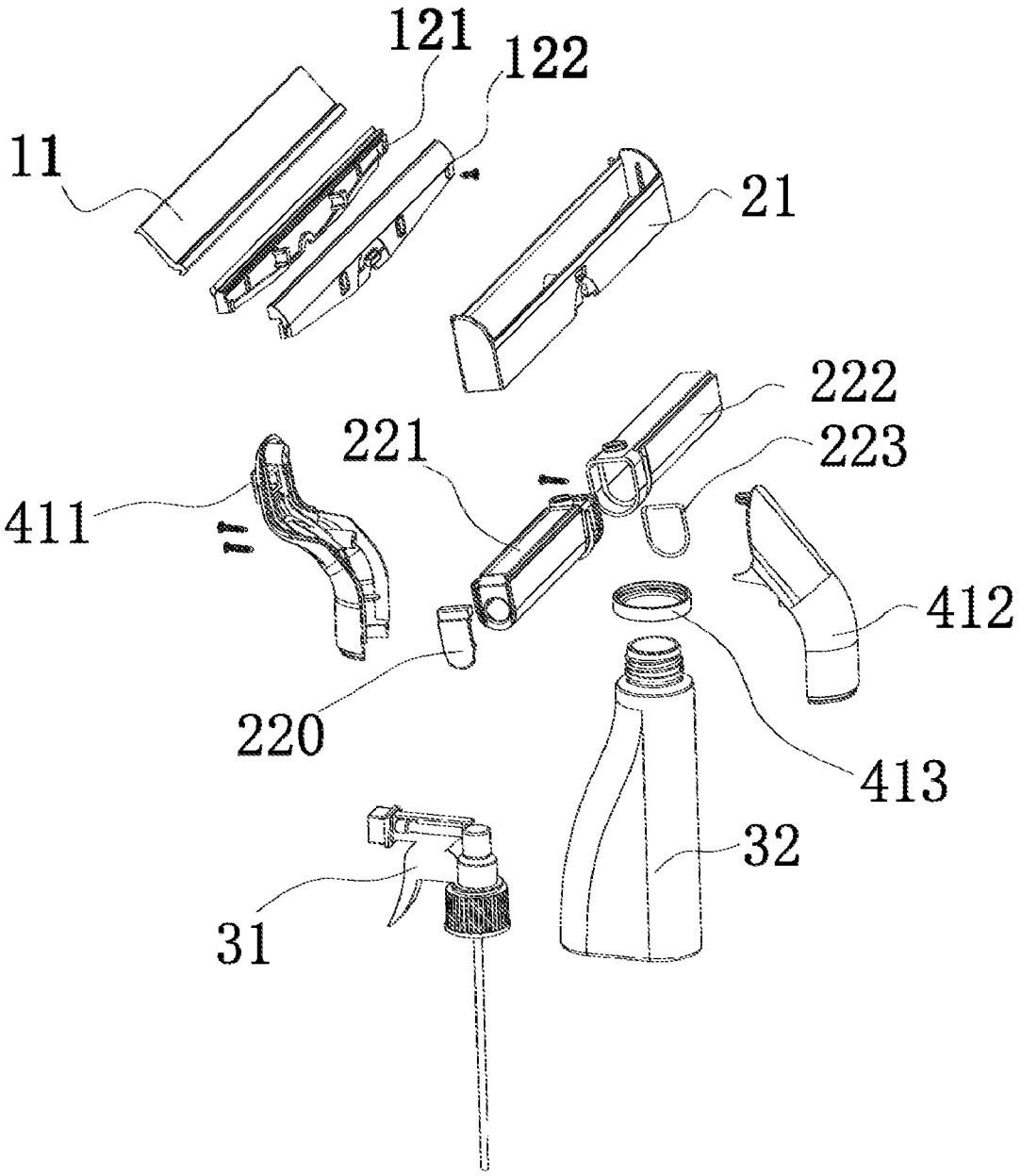
FIG. 7 is a stereogram of another window wiper.
Figure 8:
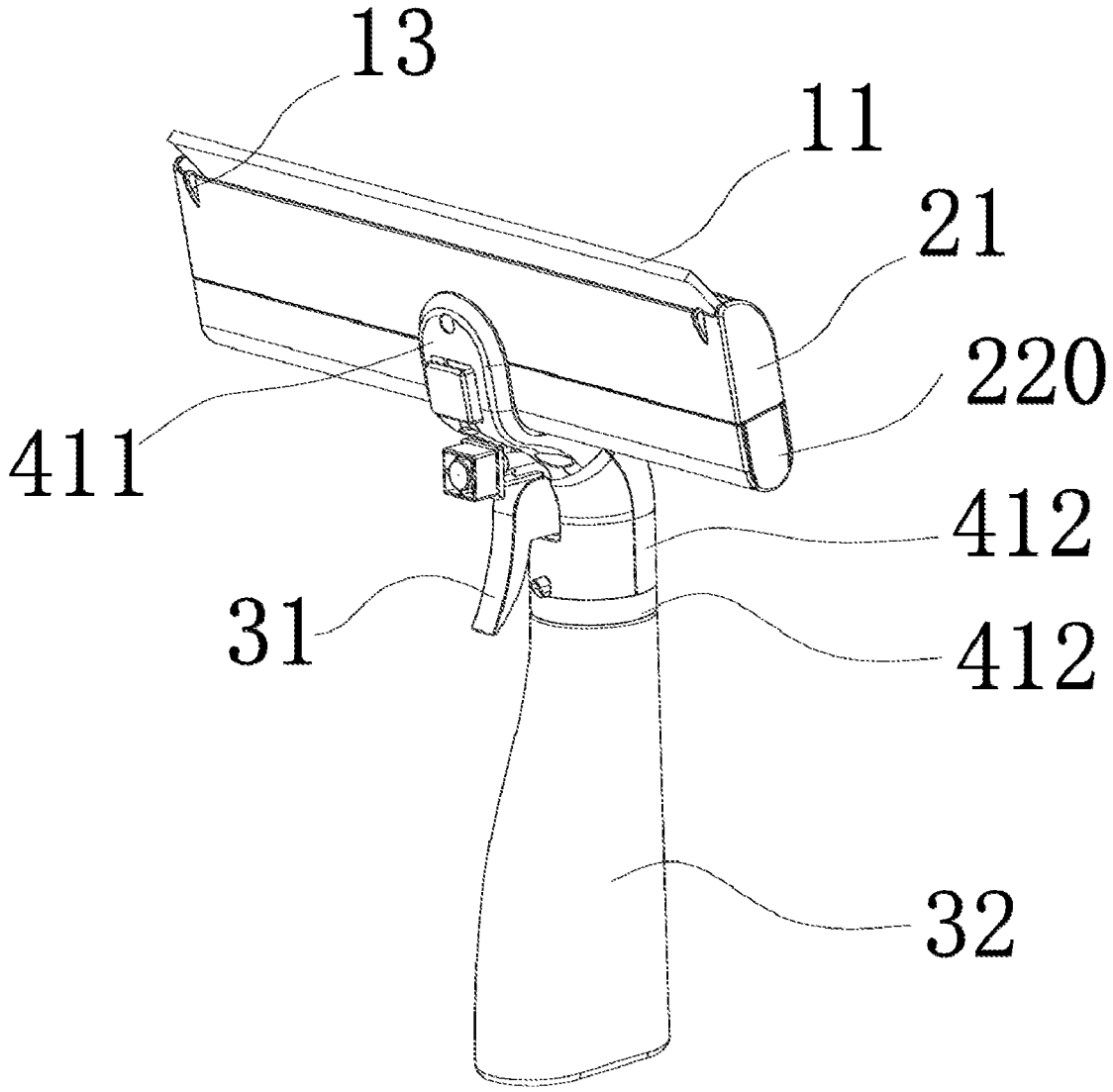
FIG. 8 is an exploded view of the window wiper in FIG. 7.
Figure 9:
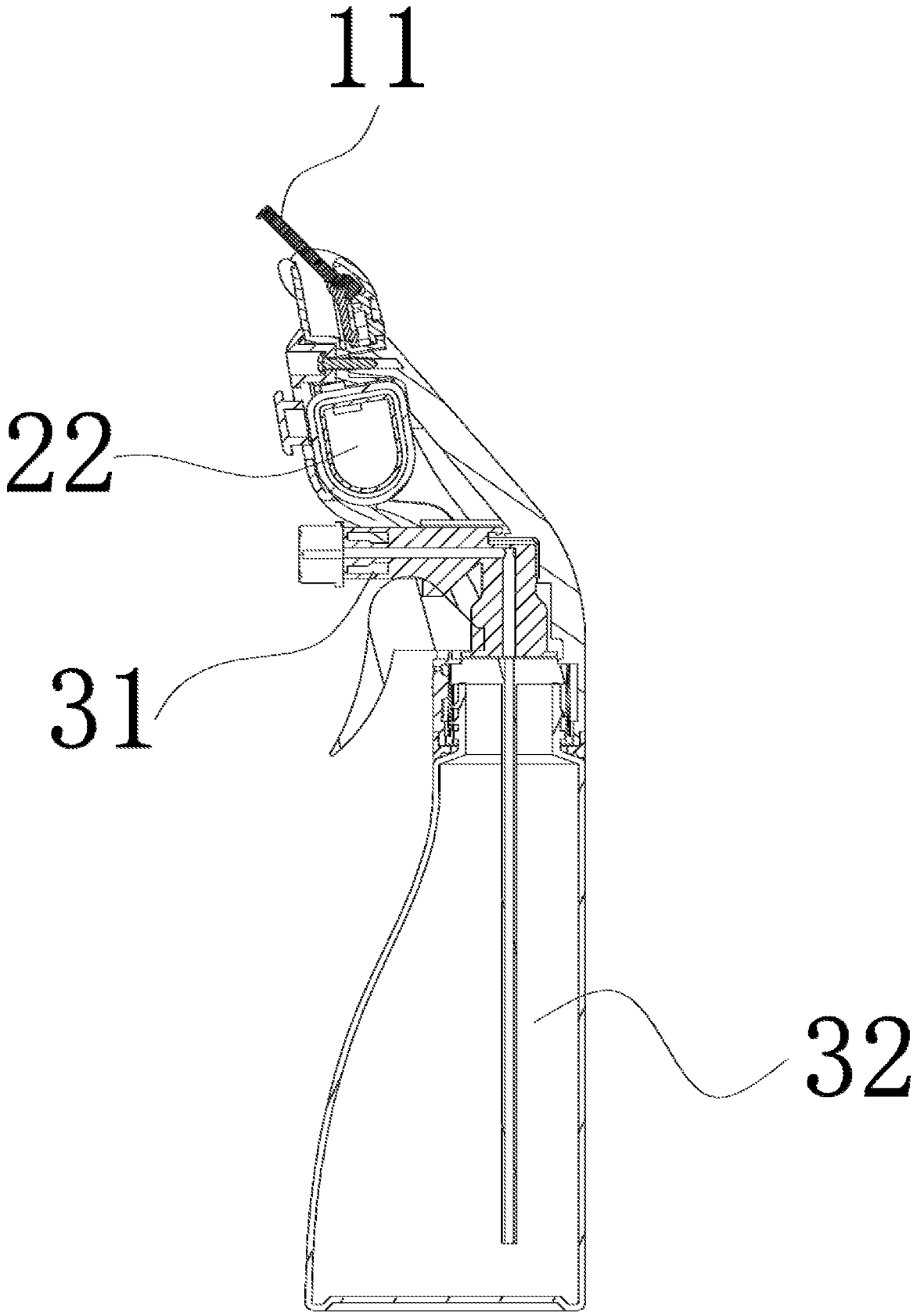
FIG. 9 is a side sectional view of the window wiper in FIG. 7.

Further, the window wiper also includes a fixing assembly, which fixes the spraying device 31 under the dirty water receiver 21. Specifically, the fixing assembly includes a first fixing cover 411 and a second fixing cover 412. The first fixing cover 411 is provided with a first through hole for the spray head and the wrench to extend out, and the shape of the first through hole is identical to that of the spray head and the wrench. After the first fixing cover 411 and the second fixing cover 412 cover the spraying device 31, they are fixedly connected by screws to reinforce the window wiper and make the window wiper look neat from the outside. Specifically, one end of the fixing assembly (the lower end as shown in FIG. 7) is fixedly connected to the mouth of the clear water bottle 32, and a fixing ring 413 is added outside the lower end of the fixing assembly to ensure connection tightness of the first fixing cover 411 and the second fixing cover 412. In order to make the window wiper more compact and firm, the other end (the upper end as shown in FIG. 7) of the fixing assembly is connected with the dirty water receiver 21. Specifically, a lower end of the dirty water receiver 21 is provided with a recess whose shape matches the shape of an upper end port of the fixing assembly, the upper end port of the fixing assembly is located in the recess in a butting mode and fixedly connected with the dirty water receiver 21 through a bolt assembly, and the bottle mouth and cap structure on the dirty water bottle extends out of the fixing assembly to facilitate subsequent treatment of the dirty water in the dirty water bottle.

It can be seen that the window wiper in this embodiment is simple in structure and easy to assemble and disassemble. When the dirty water bottle is full, one only needs to unscrew the cap of the dirty water bottle to pour out the dirty water in the dirty water bottle from the mouth of the dirty water bottle without disassembling the window wiper, which is very convenient. When the liquid (clear water or detergent) in the clear water bottle 32 is used up, only the clear water bottle 32 needs to be detached for a refill, and can be reattached afterwards to be used again.

In actual use, the user holds a holding part of the window wiper, first presses down the wrench to spray clear water or detergent onto the surface of the glass to be wiped to wet the glass to be wiped, and then presses the front end of the wiper blade 11 against the glass with the protrusions against the glass to start wiping. The dirty water coming down with the wiper blade 11 is adsorbed by the guide layer made of a water-absorbing material, and then flows into the dirty water receiving chamber along the guide layer, and finally into the dirty water bottle through the water pipes 23. In this way, dirty water will not flow down the glass to drop onto the floor, so as to prevent the lower part of the glass from being contaminated and the ground from being wetted. In addition, for a contaminant hard to remove from the window during wiping, the water spraying assembly can be used in time to spray liquid onto it, which is easy to operate and convenient to use, and can also improve the cleaning rate.

What is claimed is:

1. A window wiper, comprising a wiper blade assembly, a wiper blade mounting frame, a dirty water receiving assembly, and a handle, wherein the wiper blade mounting frame is provided with a water receiving port; when the wiper blade assembly is mounted on the handle through the wiper blade mounting frame, the wiper blade assembly comprises a wiper blade and a mounting part; the wiper blade comprises a first layer and a second layer, wherein the first layer and the second layer are arranged in a layered manner; the first layer is a scrubbing layer made of a rubber material, silica gel material, soft polyvinyl chloride (PVC) material or ethylene-vinyl acetate (EVA) material, the second layer is a guide layer made of a water-absorbing material, and the guide layer is located above the water receiving port; and a rear end of the wiper blade is connected with the mounting part, and a front end of the wiper blade is a free end, wherein the dirty water receiving assembly comprises a dirty water receiver with a dirty water receiving chamber and a dirty water bottle, wherein when the wiper blade assembly is fixed to the dirty water receiver, the guide layer of the wiper blade assembly is located above the dirty water receiving chamber, and the dirty water receiving chamber is used for receiving dirty water coming down with the wiper blade assembly and communicates with the dirty water bottle, the dirty water bottle has a bottle mouth for communicating with an outside and a bottle cap for sealing or exposing the bottle mouth, and the dirty water is discharged to the outside through the bottle mouth of the dirty water bottle;

wherein a water spraying assembly detachably connected to the dirty water receiving assembly, the water spraying assembly comprises a spraying device and a clear water bottle for containing water and/or detergent, and the spraying device communicating with the clear water bottle and being used for spraying water and/or detergent, wherein the dirty water receiving assembly further comprises water pipes, a bottom of the dirty water receiving chamber of the dirty water receiver is provided with dirty water ports, a top of the dirty water bottle is provided with dirty water nozzles, and the dirty water ports communicate with the dirty water nozzles through the water pipes, and wherein the dirty water bottle comprises a first dirty water bottle and a second dirty water bottle, wherein the first dirty water bottle and the second dirty water bottle communicate laterally, the bottle mouth and the bottle cap are arranged on one or both of the first dirty water bottle and the second dirty water bottle, and a top of the first dirty water bottle and a top of the second dirty water bottle are respectively provided with a first dirty water nozzle and a second dirty water nozzle, and the bottom of the dirty water receiving chamber of the dirty water receiver is provided with a first dirty water port corresponding to the first dirty water nozzle and a second dirty water port corresponding to the second dirty water nozzle, the first dirty water port communicates with the first dirty water nozzle through a first water pipe, and the second dirty water port communicates with the second dirty water nozzle through a second water pipe.

2. The window wiper according to claim 1, wherein the handle is provided with a hollow water storage chamber, and the water receiving port communicates with the hollow water storage chamber.

3. The window wiper according to claim 1, wherein a front end of the wiper blade mounting frame is provided with protrusions.

4. The window wiper according to claim 1, wherein the wiper blade mounting frame comprises a left side face, a rear side face, a right side face, a front side face, and a bottom face, wherein the left side face, the rear side face, the right side face, the front side face, and the bottom face define the water receiving port at a front end of the wiper blade mounting frame in an enclosing manner, and a front end of the left side face, a front end of the right side face, and/or the front side face is provided with protrusions.

5. The window wiper according to claim 1, further comprising a wiper blade mounting base, wherein the mounting part of the wiper blade assembly is a mounting bar, the wiper blade mounting base is provided with a mounting slot matched with the mounting bar, two sides of the wiper blade mounting base are respectively provided with protruding clamping pieces, and two sides of the wiper blade mounting frame are provided with clamping slots matched with the protruding clamping pieces; and the wiper blade assembly is fixed to the wiper blade mounting base by enabling the mounting bar to be clamped into the mounting slot, and the wiper blade mounting base is mounted on the wiper blade mounting frame by enabling the protruding clamping pieces to be clamped into the clamping slots.

6. The window wiper according to claim 5, wherein a bottom face of the wiper blade mounting frame is provided with a wiper blade mounting base support for supporting the wiper blade mounting base when the wiper blade mounting base is mounted on the wiper blade mounting frame.

7. The window wiper according to claim 1, wherein the water-absorbing material is cloth, paper, polyvinyl acetate (PVA) material, sponge, cellulose sponge, superfine fiber cloth, bamboo fiber or water-absorbing resin.

8. The window wiper according to claim 1, wherein the first layer and the second layer are connected together by sewing, laminating, bonding or tearable bonding.

9. The window wiper according to claim 1, wherein at the front end of the wiper blade, the first layer outreaches the second layer or is flush with the second layer.

10. The window wiper according to claim 1, wherein two sides of the wiper blade are provided with mounting bars, a mounting part of the wiper blade assembly comprises a first fixing piece arranged on a front side of the wiper blade and a second fixing piece arranged on a rear side of the wiper blade, and the first fixing piece and the second fixing piece are respectively provided with mounting slots matched with the mounting bars; and the mounting bars are clamped into the mounting slots, and the wiper blade assembly is mounted in the dirty water receiving chamber or above the dirty water receiving chamber.

11. The window wiper according to claim 10, further comprising a fixing assembly for fixing the spraying device to the dirty water receiver, wherein the fixing assembly comprises a first fixing cover located at a front side of the spraying device and a second fixing cover located at a rear side of the spraying device, the first fixing cover and the second fixing cover are connected after covering the spraying device, top ends of the first fixing cover and the second fixing cover are connected with the dirty water receiver, and bottom ends of the first fixing cover and the second fixing cover are connected with the clear water bottle.

* * * * *